US010801514B2

(12) United States Patent
Cao et al.

(10) Patent No.: US 10,801,514 B2
(45) Date of Patent: Oct. 13, 2020

(54) IMPELLER WHEEL AND CENTRIFUGAL COMPRESSOR HAVING IMPELLER WHEEL

(71) Applicant: MITSUBISHI HEAVY INDUSTRIES, LTD., Tokyo (JP)

(72) Inventors: Teng Cao, Cambridge (GB); Isao Tomita, Tokyo (JP); Liping Xu, Cambridge (GB); Tadashi Kanzaka, London (GB)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 79 days.

(21) Appl. No.: 16/266,371

(22) Filed: Feb. 4, 2019

(65) Prior Publication Data

US 2019/0271326 A1 Sep. 5, 2019

(30) Foreign Application Priority Data

Mar. 5, 2018 (JP) ..... 2018-038627

(51) Int. Cl.
*F04D 29/30* (2006.01)
*F04D 29/28* (2006.01)
(Continued)

(52) U.S. Cl.
CPC ..... *F04D 29/284* (2013.01); *F01D 5/048* (2013.01); *F01D 5/141* (2013.01); *F01D 5/34* (2013.01);
(Continued)

(58) Field of Classification Search
CPC .. F04D 29/284; F04D 29/30; F05D 2240/307; F01D 5/048; F01D 5/141
See application file for complete search history.

(56) References Cited

U.S. PATENT DOCUMENTS 4,093,401 A * 6/1978 Gravelle ..... F04D 29/284 415/143
6,508,626 B1 1/2003 Sakurai et al.
(Continued)

FOREIGN PATENT DOCUMENTS

CN 103228928 7/2013
CN 103270310 8/2013
(Continued)

OTHER PUBLICATIONS

Japanese Office Action dated Jan. 7, 2020 in corresponding Japanese Patent Application No. 2018-038627 with Machine Translation.
(Continued)

*Primary Examiner* — Ninh H. Nguyen
(74) *Attorney, Agent, or Firm* — Wenderoth, Lind & Ponack, L.L.P.

(57) ABSTRACT

An impeller wheel according to an embodiment includes a hub, a plurality of long blades disposed on a circumferential surface of the hub, the plurality of long blades extending from an inlet portion to an outlet portion of fluid and a plurality of short blades each disposed on the circumferential surface of the hub, the plurality of short blades extending from a downstream side of leading edges of the plurality of the long blades to the outlet portion in a flow passage formed between adjacent long blades of the plurality of long blades. In the impeller wheel, an expression $\beta_{2s,full}<\beta_{2s,spl}$ is satisfied, where $\beta_{2s,full}$ and $\beta_{2s,spl}$ are respectively blade angles on tip side edges of the plurality of long blades and the plurality of short blades at the outlet portion.

8 Claims, 15 Drawing Sheets

(51) Int. Cl.

| | |
|---|---|
| ***F01D 5/14*** | (2006.01) |
| ***F01D 5/34*** | (2006.01) |
| ***F04D 29/68*** | (2006.01) |
| ***F01D 5/04*** | (2006.01) |

(52) U.S. Cl.
CPC ..... *F04D 29/30* (2013.01); *F04D 29/681* (2013.01); *F05D 2220/40* (2013.01); *F05D 2240/304* (2013.01); *F05D 2240/307* (2013.01)

(56) References Cited

U.S. PATENT DOCUMENTS

| | | | | |
|---|---|---|---|---|
| 9,140,271 | B2 | 9/2015 | Sugimoto et al. | |
| 2012/0189454 | A1 | 7/2012 | Iwakiri et al. | |
| 2013/0195667 | A1 | 8/2013 | Hoshi et al. | |
| 2013/0266450 | A1 | 10/2013 | Tomita et al. | |
| 2017/0268527 | A1* | 9/2017 | Naruoka | F02B 33/40 |
| 2017/0298951 | A1* | 10/2017 | Itoh | F04D 29/284 |
| 2019/0055844 | A1* | 2/2019 | Duong | F04D 29/284 |

FOREIGN PATENT DOCUMENTS

| | | |
|---|---|---|
| EP | 2 918 849 | 9/2015 |
| GB | 941343 | 11/1963 |
| JP | 2004-044473 | 2/2004 |
| JP | 2008-196381 | 8/2008 |
| JP | 2011-80411 | 4/2011 |
| JP | 2012-127217 | 7/2012 |
| JP | 2012-140899 | 7/2012 |
| JP | 5308319 | 10/2013 |
| JP | 2014-118833 | 6/2014 |

OTHER PUBLICATIONS

The 1st Office Action dated Apr. 17, 2020 in corresponding CN application No. 201910103192.1 with Machine Translation.
Extended European Search Report dated Jul. 22, 2019 in corresponding European Patent Application No. 19155710.7.
Notice of Reasons for Refusal dated Apr. 28, 2020 in corresponding Japanese Application No. 2018-038627, with English language translation.

* cited by examiner

IMPELLER WHEEL AND CENTRIFUGAL COMPRESSOR HAVING IMPELLER WHEEL

TECHNICAL FIELD

The present disclosure relates to an impeller wheel and a centrifugal compressor having the impeller wheel.

BACKGROUND ART

A centrifugal compressor used for industrial compressors, turbochargers, and the like compresses a fluid by rotating an impeller wheel radially installed a plurality of blades and is required to have a high efficiency, a high pressure ratio, and a large capacity. The capacity is defined by the minimum flow path area, which is a throat area, formed at an inlet of the impeller wheel, then it is possible to increase the flow capacity by reducing the number of blades and increasing the throat area. In contrast, it is possible to increase pressure ratio by increasing the number of the blades at an outlet portion of the impeller wheel.

In particular, when the large capacity is required, the throat area is expanded by decreasing the number of long blades, which are full blades, and the number of blades at the outlet portion of the impeller wheel is increased by disposing each of short blades, which are splitter blades, which are shorter than the full blades, between adjacent full blades on downstream of leading edges of the full blades, which increases the pressure ratio.

Generally, it is a basic design that the splitter blades are the same shape with the full blades. However, since the fluid flowing a fluid passage between the adjacent full blades does not necessarily flow along a surface of the full blades, a mismatch, which is a coincidence, between a direction which the fluid flows and a blade angle occurs at a leading edge of the splitter blades. In a case when a load at the leading edge of the splitter blades is increased, a strong pressure distribution occurs. When the coincidence is large, peeling occurs and causes deterioration in efficiency.

Further, a gap, which is a clearance, exists between the impeller wheel and a casing covering the impeller wheel. Since a flow leaking from the clearance, which is a tip leakage flow, becomes an unintentional direction flow, which is a secondary flow, a shear layer is generated for a flow flowing the fluid passage, which is a main flow, and reduces efficiency. A pressure drop is incurred by forming a region in which the fluid hardly flows, which is a blockage area. Furthermore, the tip leakage flow forms a leakage vortex that is a vortex of a swirling flow, which is a longitudinal vortex, which causes deterioration in efficiency.

In contrast, in Patent Document 1, the coincidence at the leading edge is reduced by making the blade angle at the leading edge of the splitter blades larger than the blade angle of the full blades at the same position in a meridian plane, which improves efficiency. Further, in Patent Document 2, the splitter blades are not disposed on a line connecting between the leading edges of the full blades and the middle of the throat, which improves efficiency.

CITATION LIST

Patent Literature

Patent Document 1: JP2011-80411A
Patent Document 2: JP5308319B

SUMMARY

According to the patent Documents 1 and 2, the cause of loss directly related to the leading edge of the splitter blades is solved. However, the present inventors analyzed the loss structure in detail and found that the following two mechanisms exist as a cause of efficiency reduction by disposing the splitter blades.

(The First Mechanism)

As shown in FIG. 14, a pressure gradient in which a pressure rises toward a flow direction A of a fluid is present in a flow passage 103 of an impeller wheel having full blades 100 and a splitter blade 101. A tip leakage flow 102 does not withstand the pressure gradient and flows back toward the upstream side of the flow path 103. The tip leakage flow flowing back further leaks through clearance between a next blade, which is one of the full blades 100 or the splitter blade 101, and a casing and further flows back. The tip leakage flow 102 which repeatedly leaks next blades, which is a multiple tip leakage flow, accumulates losses every time the leakage is repeated.

(The Second Mechanism)

As shown in FIG. 15, when a leading edge 101*a* of a splitter blade 101 works, that is, when a load is applied to the leading edge 101*a* of the splitter blade 101, in a vicinity of the leading edge 101*a*, a high-pressure region 104 is generated on a pressure surface 101*b* of the splitter blade 101 and a low pressure region 105 is generated on a suction surface 101*c*. The tip leakage flow 102 reaches near the leading edge 101*a* of the splitter blade 101, wraps around the leading edge 101*a* of the splitter blade 101 so as to avoid the high-pressure region 104, and further flows back progressively. Then a blockage area is formed, which reduces efficiency.

As far as the clearance exists and the blade works, it is difficult to avoid the tip leakage flow 102. The configurations of Patent Documents 1 and 2 are not sufficient to decrease the two mechanisms. In contrast, according to the detailed analysis by present inventors, when a load to the splitter blade 101 is less than a load to the full blades 100, although the tip leakage flow leaking from the clearance between the full blades 100 and the casing cannot be reduced, the tip leakage flow 106 leaking from the clearance between the splitter blade 101 and the casing is weakened and flows toward downstream of the flow passage 103 (in the direction of Arrow B) by the fluid 107 flowing the flow passage 103. Then it has been found that the multiple tip leakage flow is suppressed and the mechanisms can be reduced.

In view of the above, an object of at least one embodiment of the present disclosure is to provide an impeller wheel which can improve efficiency of centrifugal compressors and a centrifugal compressor with the impeller wheel.

(1) An impeller wheel according to at least one embodiment of the present invention comprises:

a hub;

a plurality of long blades disposed on a circumferential surface of the hub, the plurality of long blades extending from an inlet portion to an outlet portion of fluid; and a plurality of short blades each disposed on the circumferential surface of the hub, the plurality of short blades extending from a downstream side of leading edges of the plurality of the long blades to the outlet portion in a flow passage formed between adjacent long blades of the plurality of long blades, wherein an expression $\beta_{2s,full}<\beta_{2s,spl}$ is satisfied, where $\beta_{2s,full}$ and $\beta_{2s,spl}$ are respectively blade angles on tip side edges of each long blade and each short blade at the outlet portion.

The larger the blade angle at the outlet portion, the smaller the total load, which is a total work amount, of the blades.

According to the above configuration (1), the blade angle on the tip side edge of each short blade at the outlet portion is larger than the blade angle on the tip side edge of each long blade at the outlet portion, which can reduce the load of the short blade in comparison with the load of the long blade. As a result, although the tip leakage flow leaking across the tip side edge of each long blade may not be reduced, the tip leakage flow leaking across the tip side edge of each short blade is reduced. Since the tip leakage flow which does not cross the tip side edge of each short blade flows toward the downstream of the flow passage by the fluid flowing through the flow passage. Thus, the multiple tip leakage flow is suppressed so as to improve efficiency of the centrifugal compressor.

(2) In some embodiments, in the above configuration (1), an expression $\beta_{2s,spl}-\beta_{2s,full}\geq 5°$ is satisfied.

According to the above configuration (2), the difference between the blade angle on the tip side edge of each short blade at the outlet portion and the blade angle on the tip side edge of each long blade at the outlet portion is 5° or more. Since the load of each short blade can be reliably reduced in comparison with the load of each long blade, the multiple tip leakage flow is suppressed, which can improve efficiency of the centrifugal compressor.

(3) In some embodiments, in the above configuration (1), an expression $\beta_{s,full}<\beta_{s,spl}$ is satisfied over an entire length of each short blade, where $\beta_{s,full}$ and $\beta_{s,spl}$ are respectively blade angles on the tip side edges of each long blade and the short blade at the same position when the impeller wheel is viewed from a meridian plane direction.

According to the above configuration (3), the multiple tip leakage flow is suppressed in the whole area of each short blade, which can further improve efficiency of the centrifugal compressor.

(4) In some embodiments, in any one of the above configurations (1) to (3), an expression $\beta_{2h,spl}-\beta_{2h,full}\geq 5°$ is satisfied where $\beta_{2h,full}$ and $\beta_{2h,spl}$ are respectively blade angles on hub side edges of each long blade and each short blade at the outlet portion.

The fluid flowing along a blade surface from the hub side toward the tip side leaks across the tip side edge, then the tip leakage flow is generated. Thus, the load of the short blades even on the hub side is reduced, which can further suppress the tip leakage flow. According to the above configuration (4), the difference between the blade angle on the tip side edge of each short blade at the outlet portion and the blade angle on the tip side edge of each long blade at the outlet portion is 5° or more. Since the load of each short blade on the hub side is reduced, the tip leakage flow can be further suppressed.

(5) In some embodiments, in the above configuration (4), an expression $\beta_{s,spl,m=mLE}-\beta_{s,full,m=mLE}\geq 5°$ is satisfied, where $\beta_{s,full,m=mLE}$ and $\beta_{s,spl,m=mLE}$ are respectively blade angles on the tip side edges of each long blades and each short blade at a position of a leading edge of the short blade when the impeller wheel is viewed from a meridian plane direction.

When a load is applied to the leading edge of each short blade, in a vicinity of the leading edge, a high pressure region having a high pressure is formed on a pressure surface side and a low pressure region having a low pressure is formed on a suction surface side. When the leak flow reaches the leading edge of each short blade, the tip leakage flow goes around the leading edge so as to avoid the high pressure region. Thus, the leakage is repeated. However, according to the above configuration (5), the difference between the blade angle on the tip side edge of each short blade and the blade angle of the on the tip side edge of each long blade at the leading edge of the short blade when the impeller wheel is viewed from the meridian plane direction, is 5° or more. Since the load on the leading edge of each short blade is reduced, it is difficult to form the high pressure region. As a result, the tip leakage flow which goes around the leading edge of each short blade is reduced. Since the tip leakage flow which reaches the leading edge of each short blade flows toward the downstream of the flow passage by the fluid flowing through the flow passage. Thus, the multiple tip leakage flow is suppressed so as to improve efficiency of the centrifugal compressor.

(6) In some embodiments, in the above configuration (4), an expression $\beta_{h,full,m=mLE}>\beta_{h,spl,m=mLE}$ is satisfied, where $\beta_{h,full,m=mLE}$ and $\beta_{h,spl,m=mLE}$ are respectively blade angles on the hub side edges of each long blade and each short blade at a position of a leading edge of the short blade when the impeller wheel is viewed from a meridian plane direction.

A secondary flow toward the suction surface of each short blade is generated in a boundary layer in the vicinity of the hub. The secondary flow reaches the suction surface and flows toward the tip side edge along the suction surface of each short blade, which increases the tip leakage flow. However, according to the above configuration (6), the blade angle on the hub side edge of each short blade is smaller than the blade angle on the hub side of each long blade at the position of the leading edge of the short blade when the impeller wheel is viewed from the meridian plane direction. Since a deviation between the blade angle on hub side edge at the leading edge of each short blade becomes small, the secondary flow flowing on the suction surface is reduced, which can suppress the tip leakage flow. As a result, it is possible to further improve efficiency of the centrifugal compressor.

(7) In some embodiments, in the above configuration (5), the leading edge of each short blade includes a first portion and a second portion positioned radially outward from the first portion, and an expression $\theta_1>\theta_2$ is satisfied, where $\theta_1$ is an acute angle between a direction in which the first portion extends and a rotational axis of the impeller wheel when viewed from a meridian plane, and $\theta_2$ is an acute angle between a direction in which the second portion extends and the rotational axis of the impeller wheel when viewed from the meridian plane.

When the load on the leading edge of each short blade is reduced (in the above configuration (5)), the work amount of the short blades is decreased. However, according to the above configuration (7), since the leading edge of each short blade in the vicinity of the tip side edge is inclined toward the inlet portion side compared with the other parts, this portion becomes a region in which no work is performed, then the high pressure region is hard to be formed. On the other hand, since the work in the other portion is performs, it is possible to suppress the multiple tip leakage flow while suppressing the decrease in the work amount.

(8) A centrifugal compressor according to at least one embodiment of the present invention comprises the impeller wheel according to any one of the above (1) to (7).

According to the above configuration (8), the multiple tip leakage flow is suppressed, which can further improve efficiency of the centrifugal compressor.

According to the at least one embodiment of the present disclosure, the blade angle on the tip side edge of each short blade at the outlet portion is larger than the blade angle on the tip side edge of each long blade at the outlet portion, which can reduce the load of the short blade in comparison with the load of the long blade. As a result, although the tip leakage flow leaking across the tip side edge of each long blade may not be reduced, the tip leakage flow leaking across the tip side edge of each short blade is reduced. Since the tip leakage flow which does not cross the tip side edge of each short blade flows toward the downstream of the flow passage by the fluid flowing through the flow passage. Thus, the multiple tip leakage flow is suppressed so as to improve efficiency of the centrifugal compressor.

DETAILED DESCRIPTION

Embodiments of the present invention will now be described in detail with reference to the accompanying drawings. However, the scope of the present invention is not limited to the following embodiments. It is intended that unless particularly specified, dimensions, materials, shapes, relative positions and the like of components described in the following embodiments shall be interpreted as illustrative only and not intended to limit the scope of the present invention unless particularly specified.

Embodiment 1

Figure 1:
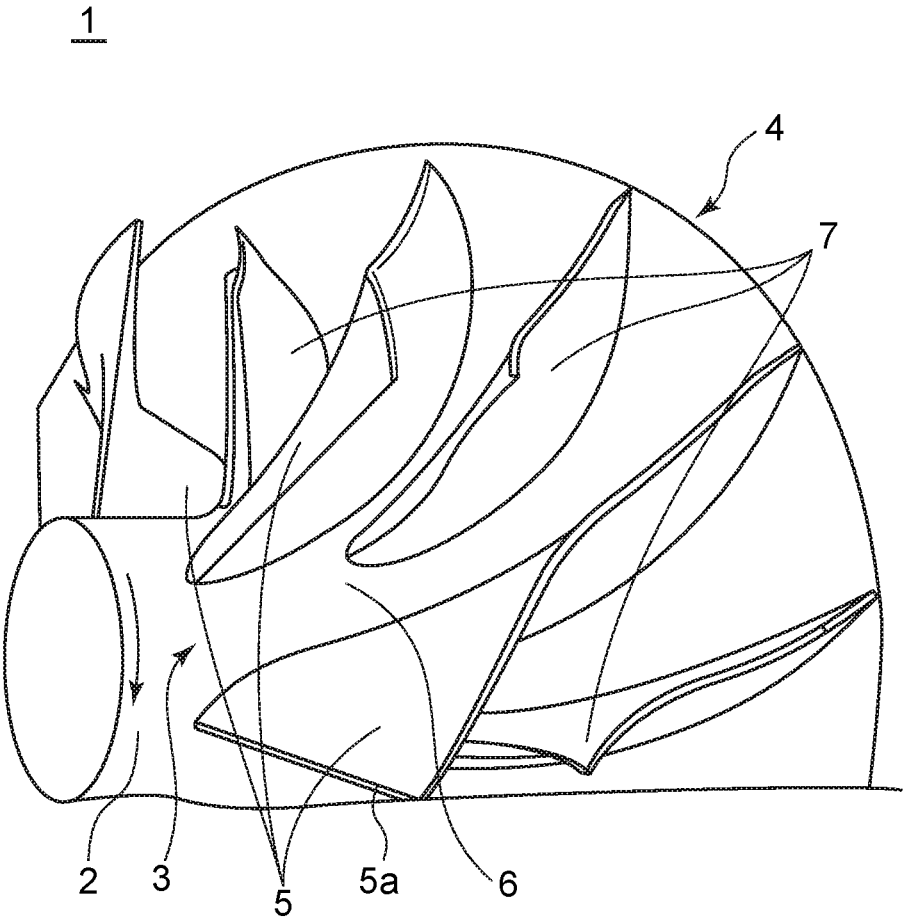
FIG. 1 is a partial perspective view of an impeller wheel according to Embodiment 1 of the present disclosure.

As shown in FIG. 1, an impeller wheel 1 according to Embodiment 1 includes a hub 2, a plurality of full blades 5, which is long blades, disposed on a circumferential surface of the hub 2 and extending from an inlet portion 3 to an outlet portion 4 of fluid, and a plurality of splitter blades 7, which is short blades, each disposed on the circumferential surface of the hub 2 and extending from a downstream side of leading edges 5*a* of the full blades 5 to the outlet portion 4 in a flow passage 6 formed between adjacent long blades 5,5. In Embodiment 1, the impeller wheel 1 will be described as being provided in a centrifugal compressor of a turbocharger.

Figure 2:
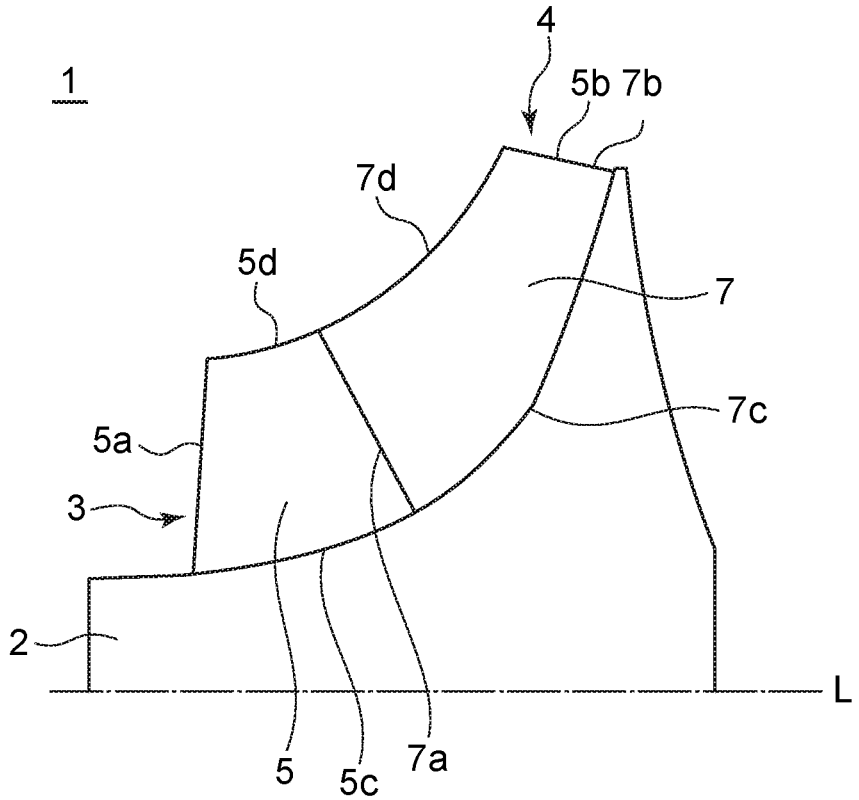
FIG. 2 is a view of a part of the impeller wheel according to Embodiment 1 of the present disclosure from a meridian plane direction.

As shown in FIG. 2, the full blades 5 each have a leading edge 5*a* which is an edge on a side of the inlet portion 3, a trailing edge 5*b* which is an edge on a side of the outlet portion 4, a hub side edge 5*c* which is an edge on a side connecting with the hub 2, and a tip side edge 5*d* which is a side facing the hub side edge 5*c*. The splitter blades 7 each have a leading edge 7*a* which is an edge on a side of the inlet portion 3, a trailing edge 7*b* which is an edge on a side of the outlet portion 4, a hub side edge 7*c* which is an edge on a side connecting with the hub 2, and a tip side edge 7*d* which is a side facing the hub side edge 7*c*. The tip side edges 5*d*, 7*d* each face an inner wall surface of a casing not shown and each form a gap (hereinafter, referred to as "clearance") with the inner wall surface of the casing.

Figure 3:
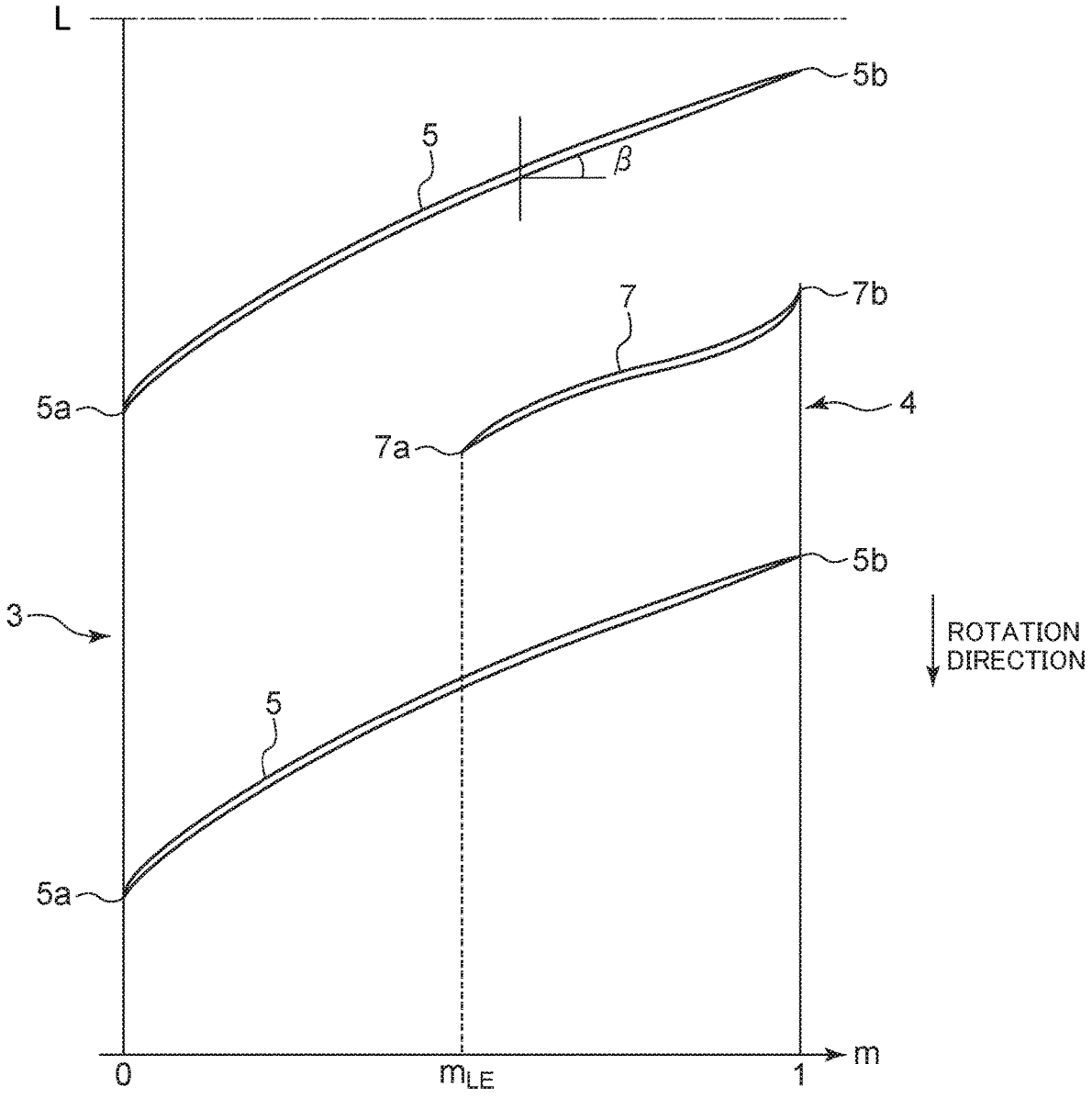
FIG. 3 is a diagram for defining a blade angle in the impeller wheel according to Embodiment 1 of the present disclosure.

FIG. 3 is a diagram for developing the respective tip side edges 5*d*, 7*d* of the full blades 5 and the splitter blades 7 on a plane along a rotation axis line L of the impeller wheel 1 (see FIG. 2) from the inlet portion 3 to the outlet portion 4. An angle β formed between the rotation axis line L and each of the full blades 5 and splitter blades 7 is defined as a blade angle. The blade angle β takes a value of 0 to 90° at an arbitrary position in a meridian plane length direction of the full blades 5 and the splitter blades 7 and at an arbitrary position in a blade height direction (in FIG. 2, a direction from the hub side edges 5*c*, 7*c* to the tip side edges 5*d*, 7*d*).

In FIG. 3, a ratio m of a length from the leading edge 5*a* of the full blades 5 in the meridian plane length direction to a meridian plane length of the full blades 5 is taken as the axis in the meridian plane length direction. Based on the definition m, the position of the leading edge 5*a* becomes m=0, and the position of the trailing edges 5*b*, 7*b* become m=1. Further, when the values of m are the same, the positions when viewed from the meridian plane direction are the same.

In the following description, the position of the leading edge 7*a* of the splitter blades 7 is represented by $m=m_{LE}$.

Figure 4:
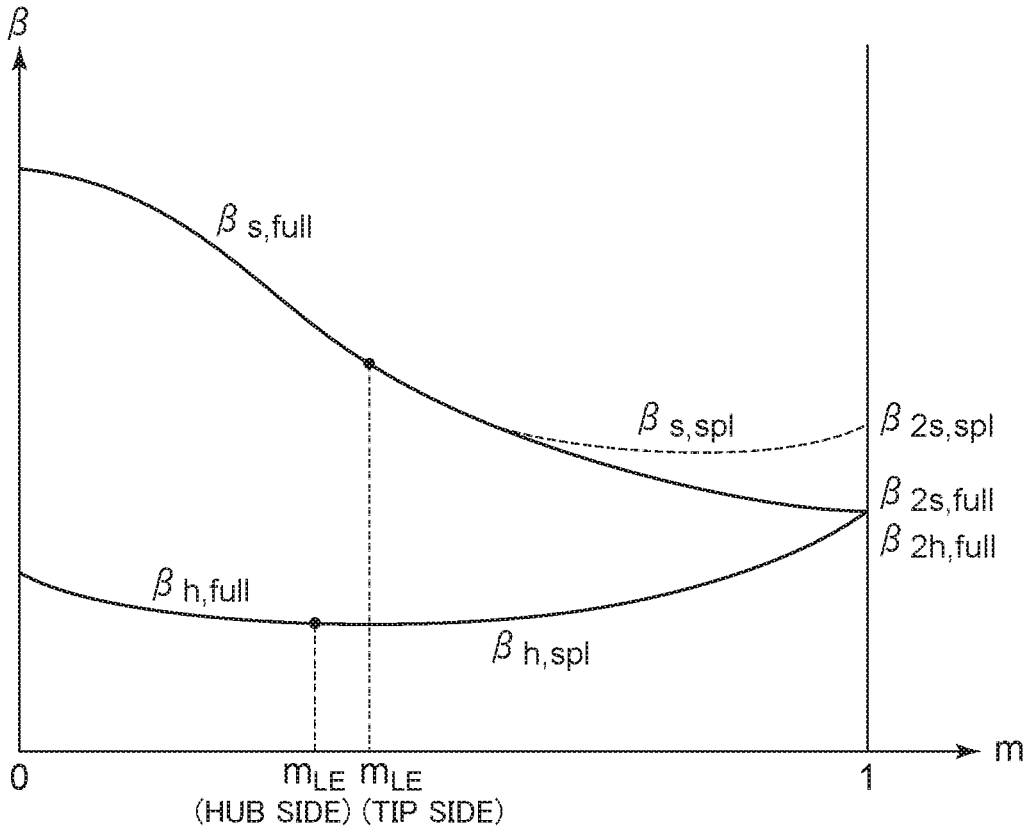
FIG. 4 is a diagram showing the distribution of the respective blade angles of the full blades and the splitter blades of the impeller wheel according to Embodiment 1 of the present disclosure.

FIG. 4 shows a distribution of the blade angles of the hub side edges 5*c*, 7*c* and the tip side edges 5*d*, 7*d* of the full blades 5 and the splitter blades 7 from the leading edges 5*a*, 7*a* to the tailing edges 5*b*, 7*b*. A blade angle $\beta_{h,spl}$ of the hub side edge 7*c* of each splitter blade 7 has the same distribution of a blade angle $\beta_{h,full}$ of the hub side edge 5*c* of each full blade 5 in a range of $m_{LE} \leq m \leq 1$.

A blade angle $\beta_{s,full}$ of the tip side edge 5*d* of each full blade 5 decreases as m increases, and becomes the same as $\beta_{h,full}$ when m=1. That is, an expression $\beta_{2s,full}=\beta_{2h,full}$ is satisfied where $\beta_{2s,full}$ and $\beta_{2h,full}$ are respectively the blade angles β on the tip side edge 5*d* and the hub side edge 5*c* when m=1.

A blade angle $\beta_{s,spl}$ on the tip side edge 7*d* of each splitter blade 7 becomes the same as $\beta_{h,full}$ when $m=m_{LE}$. That is, an expression $\beta_{s,full,m=mLE}=\beta_{h,full,m=mLE}$ is satisfied where $\beta_{s,full,m=mLE}$ and $\beta_{h,full,m=mLE}$ are respectively the blade angles on the tip side edges 5*d*, 7*d* when $m=m_{LE}$. On the other hand, an expression $\beta_{2s,full}<\beta_{2s,spl}$ is satisfied where $\beta_{2s,spl}$ is the blade angle on the tip side edge 7*d* at the outlet portion 4, that is, m=1.

Figure 5:
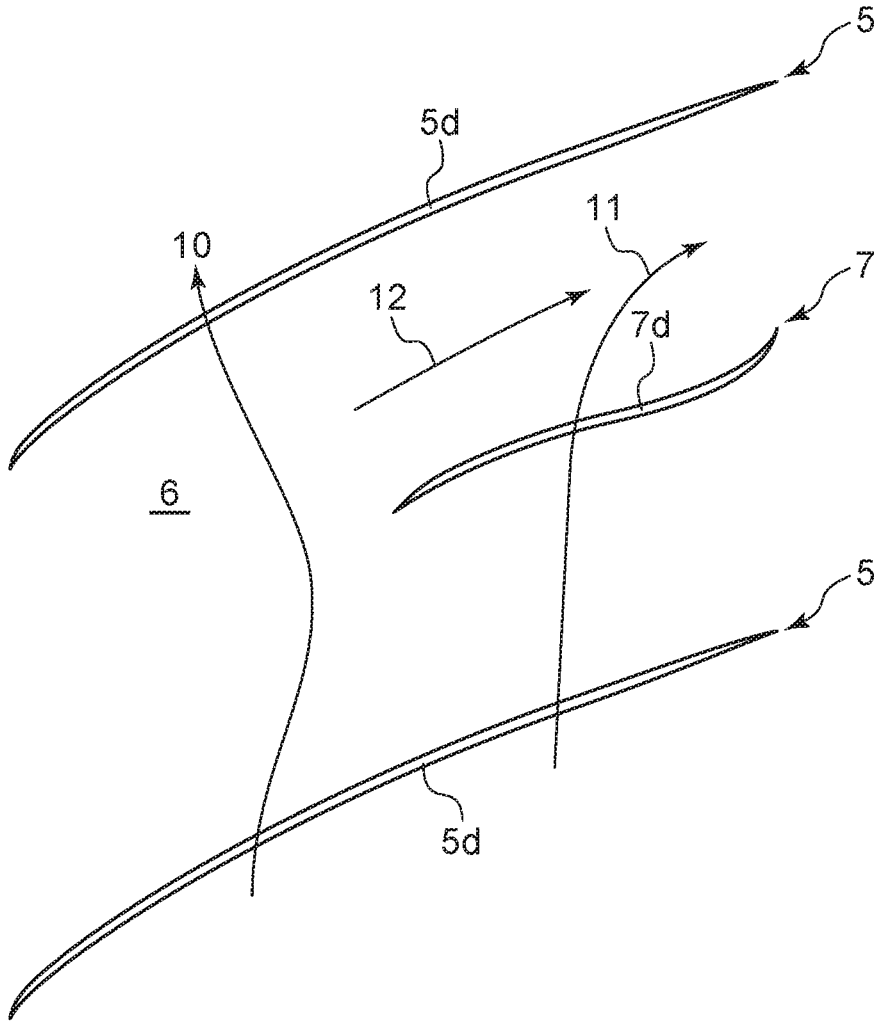
FIG. 5 is a diagram for describing the principle of suppressing multiple tip leakage flows in the impeller wheel according to Embodiment 1 of the present disclosure.

The larger the blade angles at the outlet portion 4, the smaller the total load, which is a total work amount, of the blades. According to the above configuration of Embodiment 1, since the blade angle $\beta_{2s,spl}$ on the tip side edge 7*d* of each splitter blade 7 at the outlet portion 4 is larger than the blade angle $\beta_{2s,full}$ on the tip side edge 5*d* of each full blade 5 at the outlet portion 4 ($\beta_{2s,full}<\beta_{2s,spl}$), the load of the splitter blade 7 can be reduced in comparison with the load of the full blade 5. Accordingly, as shown in FIG. 5, even if the tip leakage flow 10 leaking the clearance so as to across the tip side edge 5*d* of each full blade 5 is not reduced, the tip leakage flow 11 leaking the clearance so as to across the tip side edge 7*d* of each splitter blade 7. Thus, the tip leakage flow 11 flows toward the downstream of the flow passage 6 by the fluid 12 flowing the downstream of the flow passage 6, which suppresses the multiple tip leakage flow by that amount. As a result, it is possible to improve efficiency of the centrifugal compressor.

Figure 6:
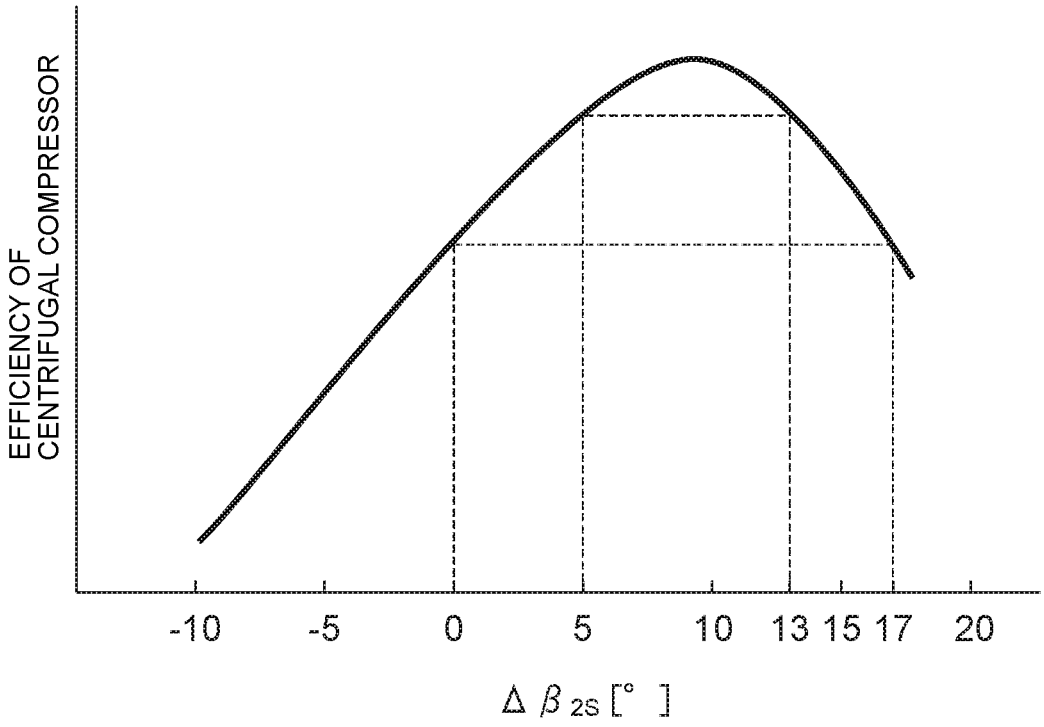
FIG. 6 is a graph showing a result of numerical calculation for efficiency of a centrifugal compressor having the impeller wheel according to Embodiment 1 of the present disclosure.

The effect of improving efficiency of the centrifugal compressor when $\beta_{2s,full}<\beta_{2s,spl}$ is confirmed by numerical calculation. The results are shown in FIG. 6. FIG. 6 shows the relationship between the difference $\Delta\beta_{2s}$ ($=\beta_{2s,spl}-\beta_{2s,full}$) between the blade angle $\beta_{2s,spl}$ on the tip edge side 7*d* of each splitter blade 7 and the blade angle $\beta_{2s,full}$ on the tip edge side 5*d* of each full blade 5 at the outlet portion 4, and the efficiency of the centrifugal compressor. In case of $\beta\beta_{2s}=0$, the blade angle $\beta_{2s,spl}$ on the tip side edge 7*d* of each splitter blade 7 is the same as the blade angle $\beta_{2s,full}$ on the tip side edge 5*d* of each full blade 5 at the outlet portion 4. In this case, under the condition of $\beta_{2s,full}<\beta_{2s,spl}$, the efficiency of the centrifugal compressor is improved in the range of $\Delta\beta_{2s}\leq 17°$ as compared with the case of $\Delta\beta_{2s}=0°$. In order to reliably improve the efficiency of the centrifugal compressor as compared with the case of $\Delta\beta_{2s}=0°$, the range of $\Delta\beta_{2s}\geq 5°$ is preferable. The range of $5°\leq\Delta\beta_{2s}\leq 13$ is more preferable.

Embodiment 2

Next, the impeller wheel according to Embodiment 2 will be described. The impeller wheel according to Embodiment 2 is different from Embodiment 1 in that the distribution of the blade angles along the meridian plane length of the tip side edge 7*d* of each splitter blade 7 is modified. In Embodiment 2, the same constituent elements as those in Embodiment 1 are associated with the same reference numerals and not described again in detail.

Figure 7:
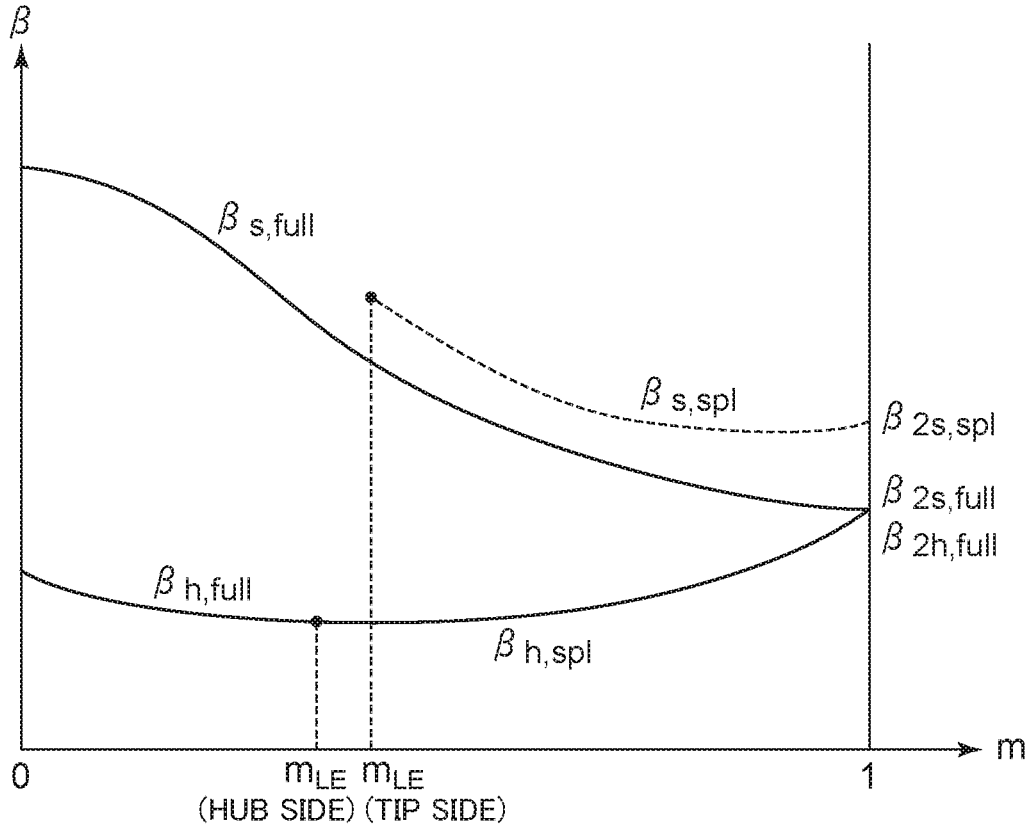
FIG. 7 is a diagram showing the distribution of the respective blade angles of the full blades and the splitter blades of the impeller wheel according to Embodiment 2 of the present disclosure.

As shown in FIG. 7, the blade angle $\beta_{s,spl}$ on the tip side edge 7*d* of each splitter blade 7 is larger than the blade angle $\beta_{s,full}$ on the tip side edge 5*d* of each full blade 5 in the range of $m_{LE}\leq m\leq 1$, that is, over the entire length of the splitter blade 7 ($\beta_{s,full}<\beta_{s,spl}$). The other configuration is the same as that of Embodiment 1.

In Embodiment 2, an expression $\beta_{s,full}<\beta_{s,spl}$ is satisfied over the entire length of each splitter blade 7, thus the multiple tip leakage flow is securely suppressed in the whole area of the splitter blades 7. Accordingly, it is possible to further improve efficiency of the centrifugal compressor in comparison with Embodiment 1.

Embodiment 3

Next, the impeller wheel according to Embodiment 3 will be described. The impeller wheel according to Embodiment 3 is different from each of Embodiments 1 and 2 in that the distribution of the blade angles along the meridian plane length of the tip side edge 7*c* of each splitter blade 7 is modified. In the following description, Embodiment 3 will be described in an aspect in which the distribution of the blades along the meridian plane length of the hub side edge 7*c* of each splitter blade 7 is modified with respect to the configuration of Embodiment 2. However, Embodiment 3 can be described in an aspect in that the distribution of the blade angles along the meridian plane length of the hub side edge 7*c* of each splitter blade 7 is modified with respect to the configuration of Embodiment 1. In Embodiment 3, the same constituent elements as those in Embodiments 1 and 2 are associated with the same reference numerals and not described again in detail.

Figure 8:
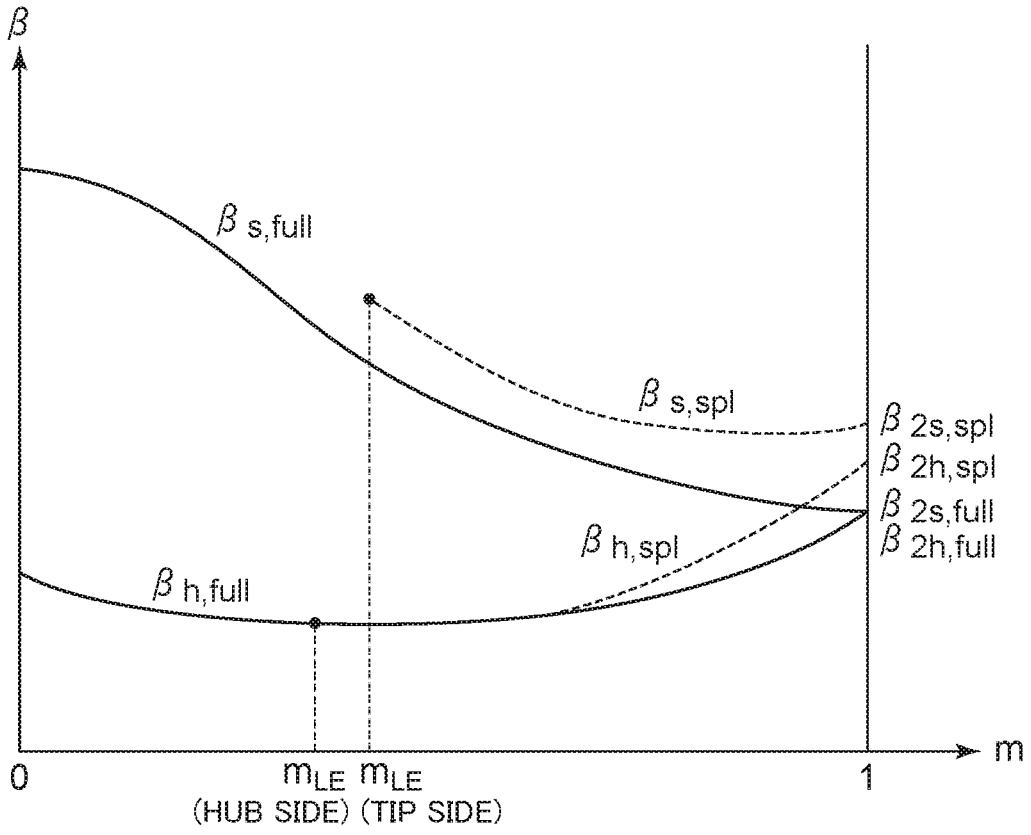
FIG. 8 is a diagram showing the distribution of the respective blade angles of the full blades and the splitter blades of the impeller wheel according to Embodiment 3 of the present disclosure.

As shown in FIG. 8, an expression $\beta_{2h,spl}-\beta_{2h,full}\geq 5°$ is satisfied at the outlet portion 4, that is, m=1. The other configuration is the same as that of Embodiment 2.

The tip leakage flow is generated by the fluid flowing along the blade surface from the hub side toward the tip side and leaking from the clearance over the tip side edges 5*d*, 7*d* (see FIG. 2). Thus, the load of the splitter blades 7 even on the hub side is reduced, which can further suppress the tip leakage flow. In Embodiment 3, the difference between the blade angle $\beta_{2h,spl}$ on the tip side edge 7*d* of each splitter blade 7 at the outlet portion 4 and the blade angle $\beta_{2h,full}$ on the tip side edge 5*d* of each full blade 5 at the outlet portion 4 is 5° or more. Since the load of the splitter blades 7 even on the hub side can be reduced, the tip leakage flow can be further suppressed in comparison with Embodiment 2.

Embodiment 4

Next, the impeller wheel according to Embodiment 4 will be described. The impeller wheel according to Embodiment 4 is different from Embodiment 3 in that the distribution of the blade angles along the meridian plane length of the tip side edge 7*d* of each splitter blade 7 is modified. In Embodiment 4, the same constituent elements as those in Embodiments 1 to 3 are associated with the same reference numerals and not described again in detail.

Figure 9:
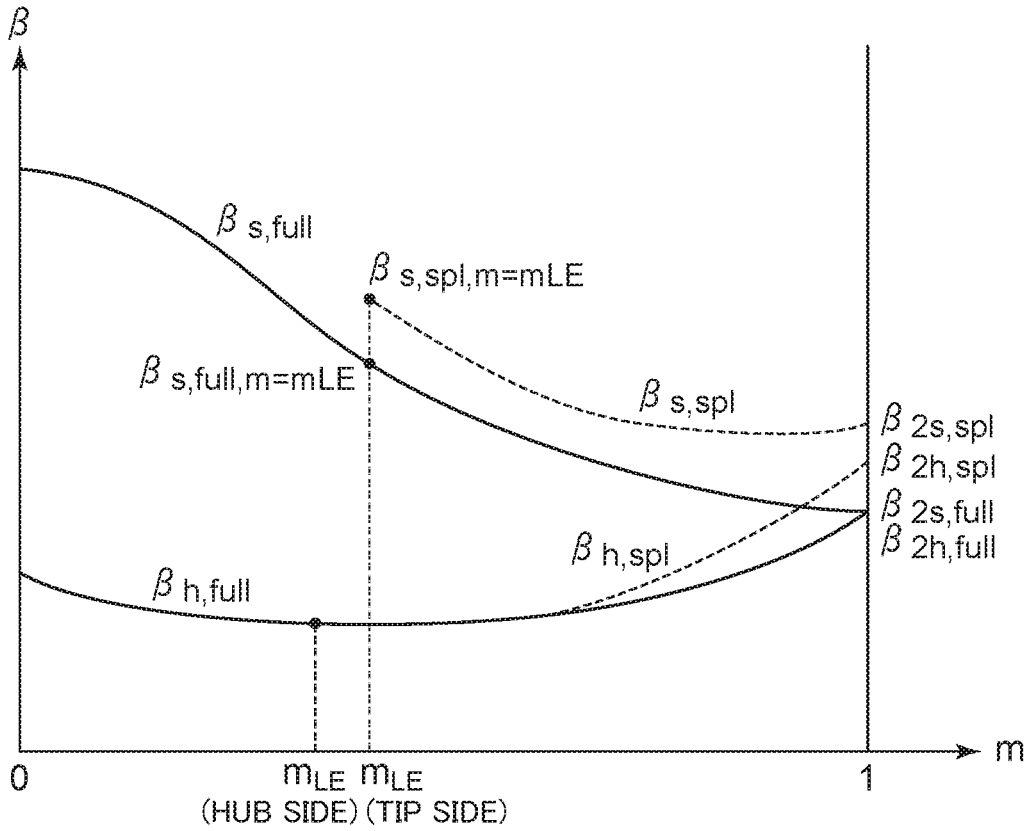
FIG. 9 is a diagram showing the distribution of the respective blade angles of the full blades and the splitter blades of the impeller wheel according to Embodiment 4 of the present disclosure.

As shown in FIG. 9, the blade angle $\beta_{s,spl}$ on the tip side edge 7*d* of each splitter blade 7 is larger than the blade angle $\beta_{s,full}$ on the tip side edge 5*d* of each full blade 5 in the range of $m_{LE}\leq m\leq 1$, that is, over the entire length of the splitter blade 7 ($\beta_{s,full}<\beta_{s,spl}$). Further, an expression $\beta_{s,spl,m=mLE}-\beta_{s,full,m=mLE}\geq 5°$ is satisfied where $\beta_{s,full,m=mLE}$ and $\beta_{s,spl,m=mLE}$ are respectively the blade angles on the tip side edge 5*d* of the full blade 5 and on the tip side edge 7*d* of the splitter blade 7 at $m=m_{LE}$. The other configuration is the same as that of Embodiment 3.

Figure 10:
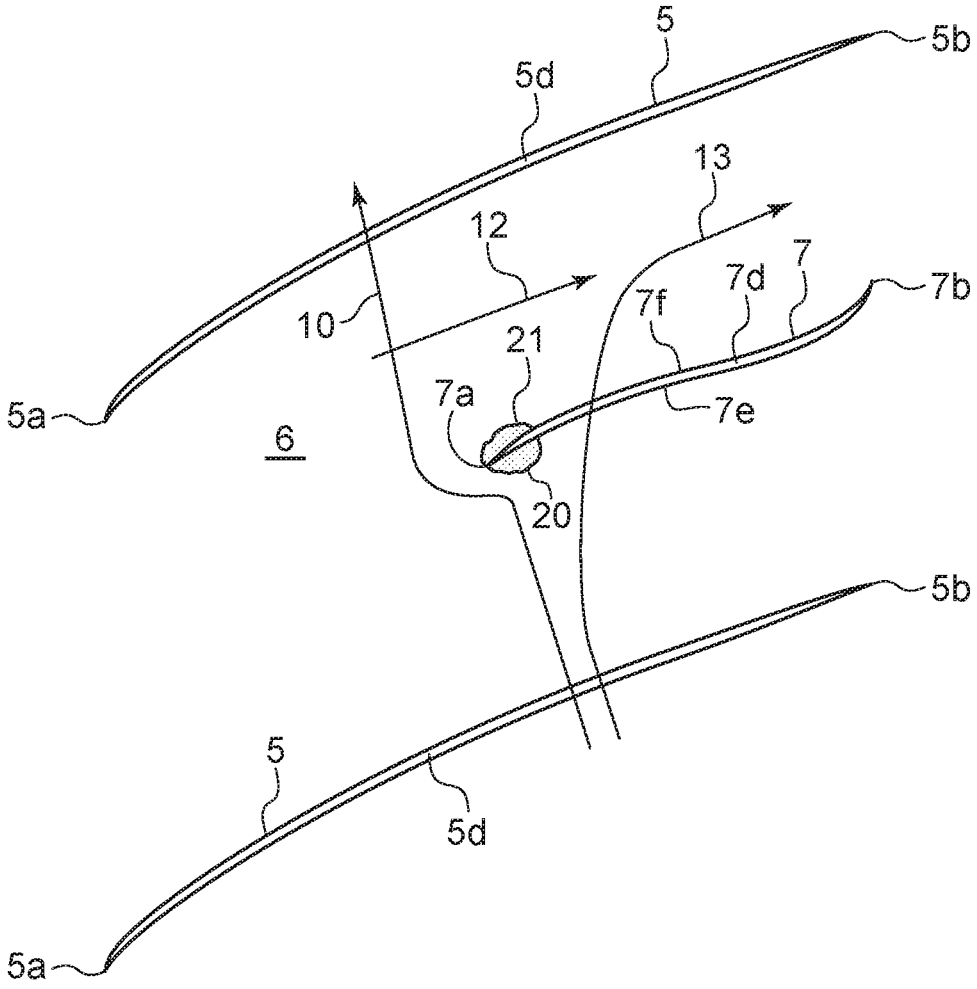
FIG. 10 is a diagram for describing the principle of suppressing multiple tip leakage flows in the impeller wheel according to Embodiment 4 of the present disclosure.

As shown in FIG. 10, when a load is applied to the leading edge 7*a* of each splitter blade 7, in a vicinity of the leading edge 7*a*, a high pressure region 20 having a high pressure is formed on a side of a pressure surface 7*e* and a low pressure region 21 having a low pressure is formed on a side of a suction surface 7*f*. When the leak flow 10 reaches the leading edge 7*a*, the tip leakage flow 10 goes around the leading edge 7*a* so as to avoid the high pressure region 20. Thus, the leakage is repeated. However, in Embodiment 4, the expression $\beta_{s,spl,m=mLE}-\beta_{s,full,m=mLE}\geq 5°$ is satisfied where $m=m_{LE}$. Since the load of the leading edge 7*a* is reduced, it is difficult to form the high pressure region 20. As a result, the tip leakage flow 10 which goes around the leading edge 7*a* is reduced. The tip leakage flow 13 leaking from the clearance across the tip side edge 7*d* of each splitter blade 7 is weakened and flows toward downstream of the flow passage 6 by the fluid 12 flowing the flow passage 6. Then the multiple tip leakage flow is suppressed, which improves efficiency of the centrifugal compressor.

Embodiment 5

Next, the impeller wheel according to Embodiment 5 will be described. The impeller wheel according to Embodiment 5 is different from Embodiment 3 in that the distribution of the blade angles along the meridian plane length of the tip side edge 7*c* of each splitter blade 7 is modified. In Embodiment 5, the same constituent elements as those in Embodiments 1 to 3 are associated with the same reference numerals and not described again in detail.

Figure 11:
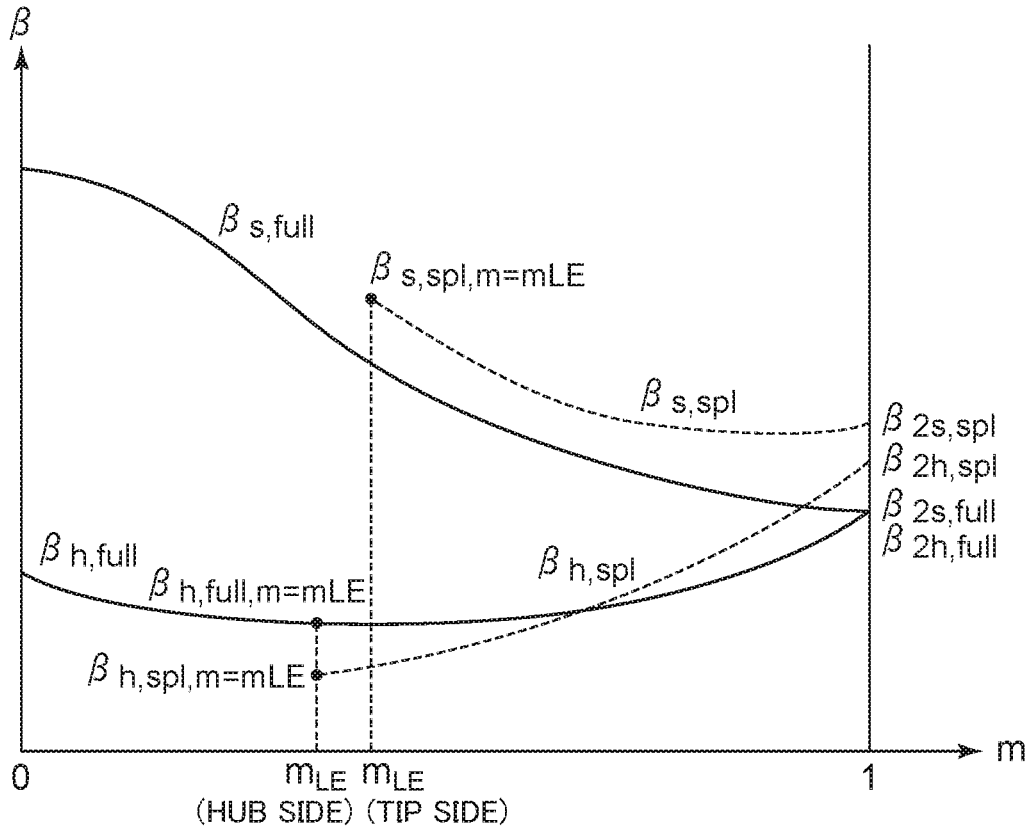
FIG. 11 is a diagram showing the distribution of the respective blade angles of the full blades and the splitter blades of the impeller wheel according to Embodiment 5 of the present disclosure.

As shown in FIG. 11, an expression $\beta_{h,full,m\text{-}mLE}>\beta_{h,spl,m\text{-}mLE}$ is satisfied where $\beta_{h,full,m=mLE}$ is the blade angle on the hub side edge 5*c* of each full blade 5 and $\beta_{h,spl,m=mLE}$ is the blade angle on the hub side edge 7*c* of each splitter blade 7 when $m=m_{LE}$. The other configuration is the same as that of Embodiment 3.

Figure 12:
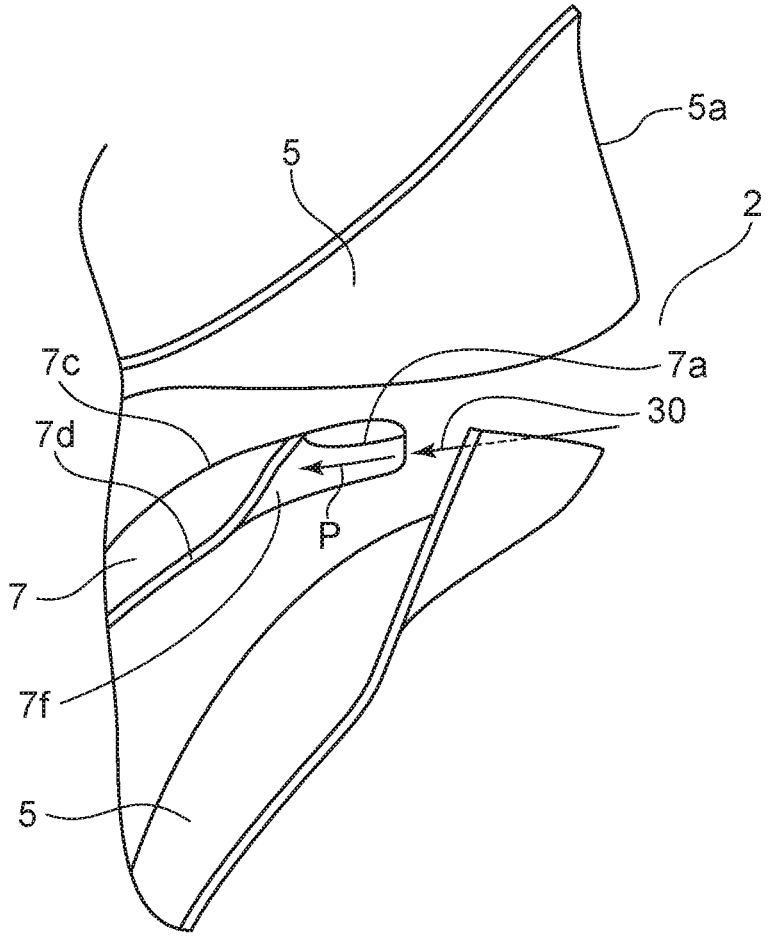
FIG. 12 is a diagram for describing the principle of suppressing tip leakage flows in the impeller wheel according to Embodiment 5 of the present disclosure.

In shown in FIG. 12, a secondary flow 30 toward the suction surface 7*f* of each splitter blade 7 is generated in a boundary layer in the vicinity of the hub 2. The secondary flow 30 reaches the suction surface 7*f* and flows toward the tip side edge 7*d* (in the direction of Arrow P) along the suction surface 7*f*, which increases the tip leakage flow. However, in Embodiment 5, the expression $\beta_{h,full,m=mLE}>\beta_{h,spl,m=mLE}$ is satisfied where $m=m_{LE}$. Since a deviation between the blade angle on the hub side edge 7*c* at the leading edge 7*a* of each splitter blade 7 and a direction of the secondary flow 30 becomes small, the secondary flow 30 flowing on the suction surface 7*f* is reduced, which can suppress the tip leakage flow. As a result, it is possible to further improve efficiency of the centrifugal compressor.

Embodiment 6

Next, the impeller wheel according to Embodiment 6 will be described. The impeller wheel according to Embodiment 6 is different from Embodiment 4 in that the shape of the leading edge 7*a* of each splitter blade 7 is modified. In Embodiment 6, the same constituent elements as those in Embodiments 1 to 4 are associated with the same reference numerals and not described again in detail.

Figure 13:
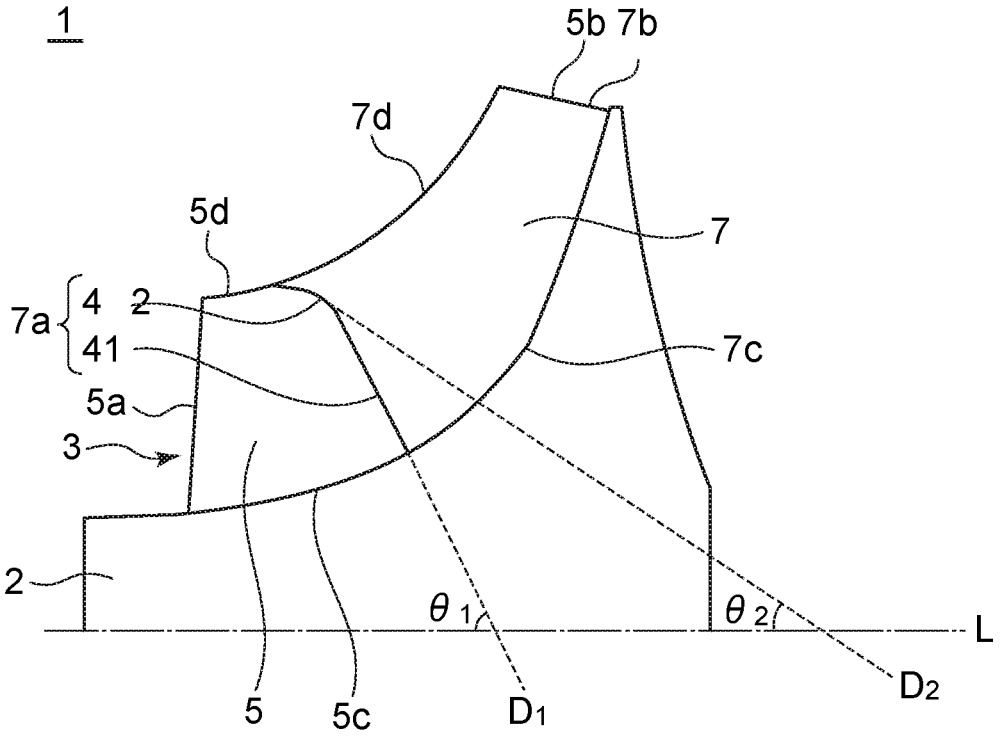
FIG. 13 is a view of a part of the impeller wheel according to Embodiment 6 of the present disclosure from a meridian plane direction.
Figure 14:
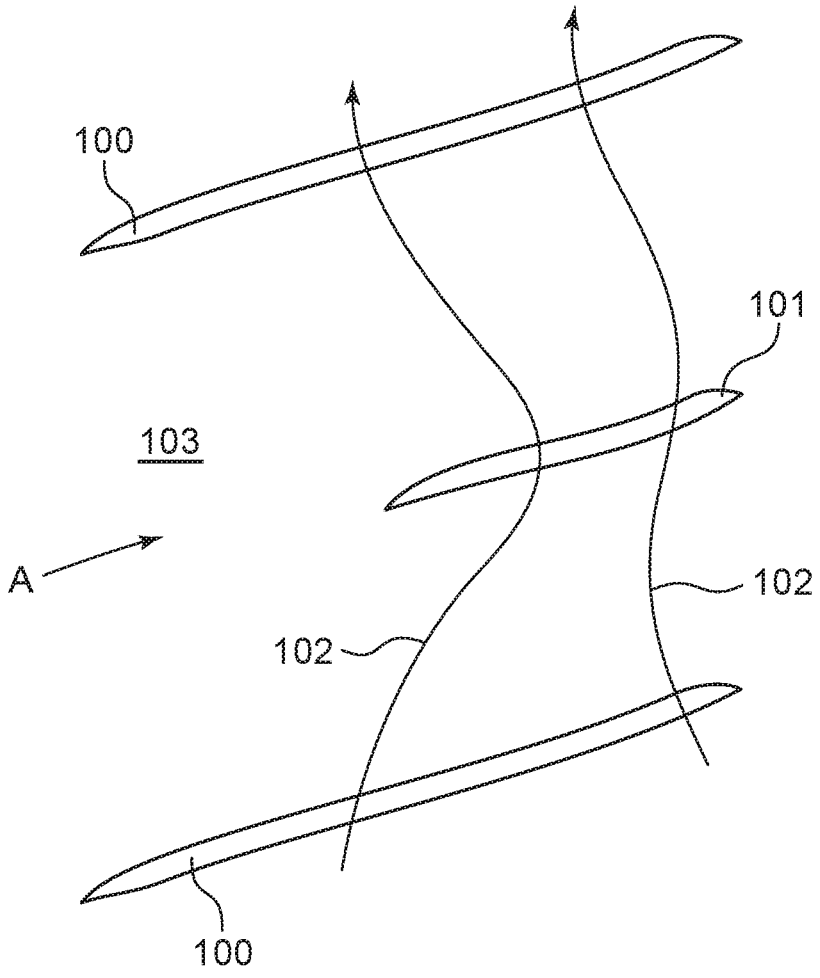
FIG. 14 is a diagram for describing a mechanism for the reason of efficiency reduction by disposing the splitter blades at the conventional impeller wheel.
Figure 15:
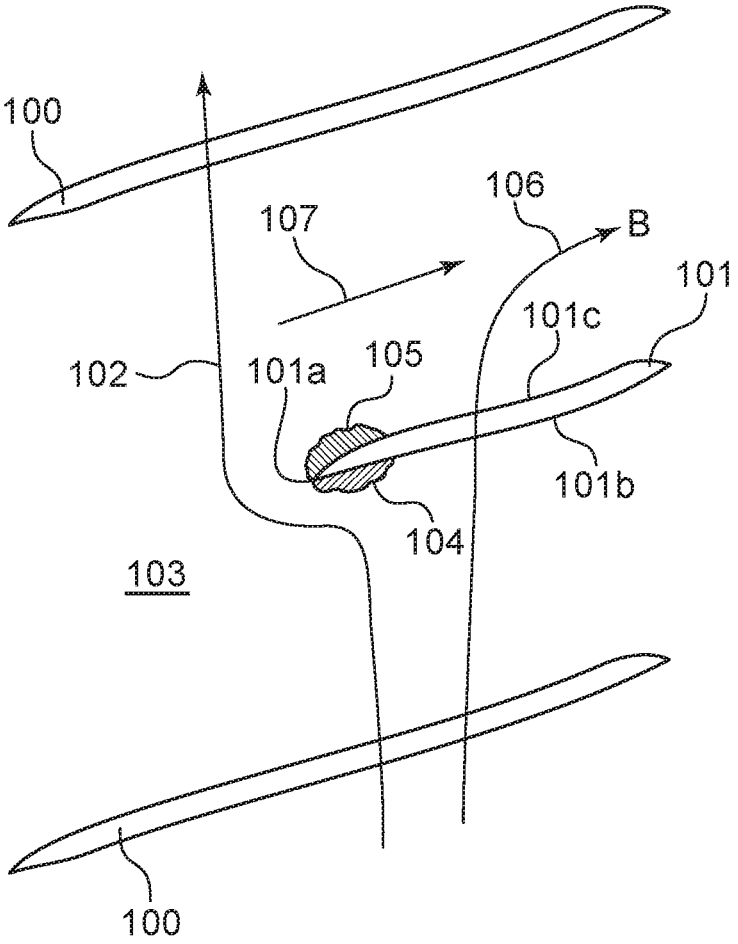
FIG. 15 is a diagram for describing another mechanism for the reason of efficiency reduction by disposing the splitter blades at the conventional impeller wheel.

As shown in FIG. 13, the leading edge 7*a* of each splitter blade 7 includes a first portion 41 and a second portion 42 positioned radially outward from the first portion 41. an expression $\theta_1>\theta_2$ is satisfied, where $\theta_1$ is an acute angle between a direction $D_1$ in which the first portion 41 extends and a rotational axis L of the impeller wheel 1 when viewed from the meridian plane, and $\theta_2$ is an acute angle between a direction $D_2$ in which the second portion 42 extends and the rotational axis L of the impeller wheel 1 when viewed from the meridian plane. The other configuration is the same as that of Embodiment 4.

If the load of the leading edge 7*a* of each splitter blade 7 is reduced as in Embodiment 4, the work amount of the splitter blades 7 is decreased. However, according to Embodiment 6, since the leading edge 7*a* of each splitter blade 7 in the vicinity of the tip side edge 7*d* is inclined toward the inlet portion 3 side compared with the other parts, this portion becomes a region in which no work is performed, then the high pressure region (see the high pressure region 20 in FIG. 10) on the pressure surface 7*e* of the splitter blade 7 is hard to be formed. On the other hand, since the work in the other portion is performs, it is possible to suppress the multiple tip leakage flow while suppressing the decrease in the work amount.

The invention claimed is:

1. An impeller wheel comprising:

a hub;

a plurality of long blades disposed on a circumferential surface of the hub, the plurality of long blades extending from an inlet portion to an outlet portion of fluid; and a plurality of short blades each disposed on the circumferential surface of the hub, the plurality of short blades extending from a downstream side of leading edges of the plurality of the long blades to the outlet portion in a flow passage formed between adjacent long blades of the plurality of long blades, wherein an expression $\beta_{2s,full}<\beta_{2s,spl}$ is satisfied, where $\beta_{2s,full}$ and $\beta_{2s,spl}$ are respectively blade angles on tip side edges of each long blade and each short blade at the outlet portion.

2. The impeller wheel according to claim 1, wherein an expression $\beta_{2s,spl}-\beta_{2s,full}\geq 5°$ is satisfied.

3. The impeller wheel according to claim 1, wherein an expression $\beta_{s,full}<\beta_{s,spl}$ is satisfied over an entire length of each short blade, where $\beta_{s,full}$ and $\beta_{s,spl}$ are respectively blade angles on the tip side edges of each long blade and the short blade at the same position when the impeller wheel is viewed from a meridian plane direction.

4. The impeller wheel according to claim 1, wherein an expression $\beta_{2h,spl}-\beta_{2h,full}\geq 5°$ is satisfied where $\beta_{2h,full}$ and $\beta_{2h,spl}$ are respectively blade angles on hub side edges of each long blade and each short blade at the outlet portion.

5. The impeller wheel according to claim 4, wherein an expression $\beta_{s,spl,m=mLE}-\beta_{s,full,m=mLE}\geq 5°$ is satisfied, where $\beta_{s,full,m=mLE}$ and $\beta_{s,spl,m=mLE}$ are respectively blade angles on the tip side edges of each long blade and each short blade at a position of a leading edge of the short blade when the impeller wheel is viewed from a meridian plane direction.

6. The impeller wheel according to claim 5, wherein the leading edge of each short blade includes a first portion and a second portion positioned radially outward from the first portion, and wherein an expression $\theta_1>\theta_2$ is satisfied, where $\theta_1$ is an acute angle between a direction in which the first portion extends and a rotational axis of the impeller wheel when viewed from a meridian plane, and $\theta_2$ is an acute angle between a direction in which the second portion extends and the rotational axis of the impeller wheel when viewed from the meridian plane.

7. The impeller wheel according to claim 4, wherein an expression $\beta_{h,full,m=mLE}>\beta_{h,spl,m=mLE}$ is satisfied, where $\beta_{h,full,m=mLE}$ and $\beta_{h,spl,m=mLE}$ are respectively blade angles on the hub side edges of each long blade and each short blade at a position of a leading edge of the short blade when the impeller wheel is viewed from a meridian plane direction.

8. A centrifugal compressor comprising:

the impeller wheel according to claim 1.

* * * * *